United States Patent [19]

Hoffman et al.

[11] Patent Number: 4,661,766

[45] Date of Patent: Apr. 28, 1987

[54] DUAL CURRENT SENSING DRIVER CIRCUIT

[75] Inventors: John P. Hoffman, Peoria; Weldon L. Phelps, Dunlap, both of Ill.

[73] Assignee: Caterpillar Inc., Peoria, Ill.

[21] Appl. No.: 812,677

[22] Filed: Dec. 23, 1985

[51] Int. Cl.[4] ..... G05F 1/56

[52] U.S. Cl. ..... 323/287; 318/139; 361/160

[58] Field of Search ..... 323/285–288; 307/270; 361/160, 170; 318/139

[56] References Cited

U.S. PATENT DOCUMENTS

| | | | |
|---|---|---|---|
| 3,914,671 | 10/1975 | Morton et al. | 318/139 |
| 3,973,176 | 8/1976 | Rohsler | 318/139 X |
| 4,074,175 | 2/1978 | Born et al. | 323/287 X |
| 4,446,410 | 5/1984 | Yagura et al. | 318/687 |

FOREIGN PATENT DOCUMENTS

| | | | |
|---|---|---|---|
| 2561471 | 9/1985 | France . | |
| 1076888 | 2/1984 | U.S.S.R. | 323/287 |

OTHER PUBLICATIONS

O'Sullivan et al., "Advances in Spacecraft Power Conditioning–New Concepts from Old", ESA Journal 1977, vol. 1, No. 4, pp. 345–352.

*Primary Examiner*—Peter S. Wong
*Attorney, Agent, or Firm*—Terry D. Morgan

[57] ABSTRACT

A hybridized solenoid driver circuit includes a first and second current sensing resistor. The first current sensing resistor is disposed within the flyback current path of the windings of an electrically actuated solenoid and provides a signal proportional to the flyback current only. Control of the solenoid current is effected by operation of a power transistor to controllably connect and disconnect the solenoid from the power supply at a preselected duty cycle. Operation of the driver circuit in the energization mode has no effect on the first current sensing resistor. Conversely, the second current sensing resistor is disposed within the energization current path and provides a signal proportional to the energization current only. Operation of the driver circuit in the flyback mode has no effect on the second current sensing resistor. A summing amplifier receives the first signal directly from the first current sensing resistor as it is referenced to ground; however, the second current sensing resistor is referenced to positive battery and the second signal must be passed through a current mirror prior to delivery to the summing amplifier. The signal provided by the summing amplifier is used by a control circuit to maintain the solenoid current at a desired level by constantly adjusting the duty cycle of a biasing signal delivered to the power transistor.

7 Claims, 2 Drawing Figures

DUAL CURRENT SENSING DRIVER CIRCUIT

1. Technical Field

This invention relates generally to a driver circuit for controlling the magnitude of current delivered to a winding of a solenoid, and more particularly, to a driver circuit which has separate means for sensing the current flowing during energization and flyback.

2. Background Art

In the field of driver circuits, there are many variations in solenoid driver circuitry used in industry today. The majority of these include means for sensing the solenoid current to regulate the current in a closed loop system. In previous solenoid circuitry, a single resistor is commonly used to sense the current supplied to the solenoid. In such an arrangement, there are two locations where a single resistor can be located to sense both the current supplied to the solenoid when the driver is "on" and the flyback current when the driver is turned "off". The flyback current is a significant portion of the total current when the driver is used in a pulse width modulated application.

A common location for the single current sensing resistor is in the ground return line intermediate the junction of the flyback diode and the solenoid winding. The advantages of this location are that only a single resistor is required to sense solenoid current and a simple electronic circuit can be used to process the signal. However, there are distinct disadvantages in using a single resistor at this location. For example, if the solenoid return line should short to ground, the current sensing resistor would have zero voltage drop across it, just as if no current were flowing through the solenoid coil. If this circuit were used in a closed loop system, the fault would cause the control to output maximum current in an effort to obtain the desired current. The solenoid would turn fully "on" and move the controlled element to an extreme position which would be an unacceptable failure mode for systems controlling large forces such as hydraulic cylinders and engine controls. Conversely, if the solenoid return line is shorted to battery voltage considerable power must be dissipated by the sensing resistor. In a typical system, the power rating of the resistor required would be costly as well as physically large and is undesirable in electronic controls. A smaller power resistor would quickly burn out, thus disabling the control. Owing to the difficulty in repairing board mounted components in the field, the resulting loss in production as well as the cost of the control make this an undesirable condition.

A second location for the single sensing resistor is in the driver output line intermediate the junction of the cathode of the flyback diode and the winding. There are inherent disadvantages associated with locating the current sensing resistor at the second location. When the driver is turned "on", the circuit must sense a voltage drop of typically 1 volt, within a 1% tolerance where the common mode voltage is within one or two volts of the relatively high supply voltage. When the solenoid turns "off", the output voltage will be near zero and a negative voltage will be created across the resistor as a result of the flyback current through the diode. The sensing circuitry must be able to respond to this changing condition and yet maintain the desired accuracy. The complexity of the circuitry required to accurateiy respond to the variable reference voltage drop results in an unduly expensive driver circuit and is not considered to be a viable option.

The present invention is directed to overcoming one or more of the problems as set forth above.

DISCLOSURE OF THE INVENTION

In accordance with one aspect of the present invention, there is provided a driver circuit which controllably connects an inductive load to a source of electrical power. The inductive load has a reverse biased flyback diode connected in parallel with an inductive winding of a solenoid. The driver circuit comprises a switching means which respectively connects and disconnects the inductive load to and from the source in response to receiving a first and second control signal. A first means senses the current flowing only through the flyback diode and delivers a signal which has a magnitude responsive to the magnitude of the flyback current. A second means senses the current flowing only through the switching means and delivers a signal having a magnitude proportional to the magnitude of the switching means current. A means receives the flyback and switching current signals and respectively delivers one of the first and second control signals to the switching means in response to the first signal being less than a first preselected value and the second signal being greater than a second preselected value.

BEST MODE FOR CARRYING OUT THE INVENTION

Figure 1:
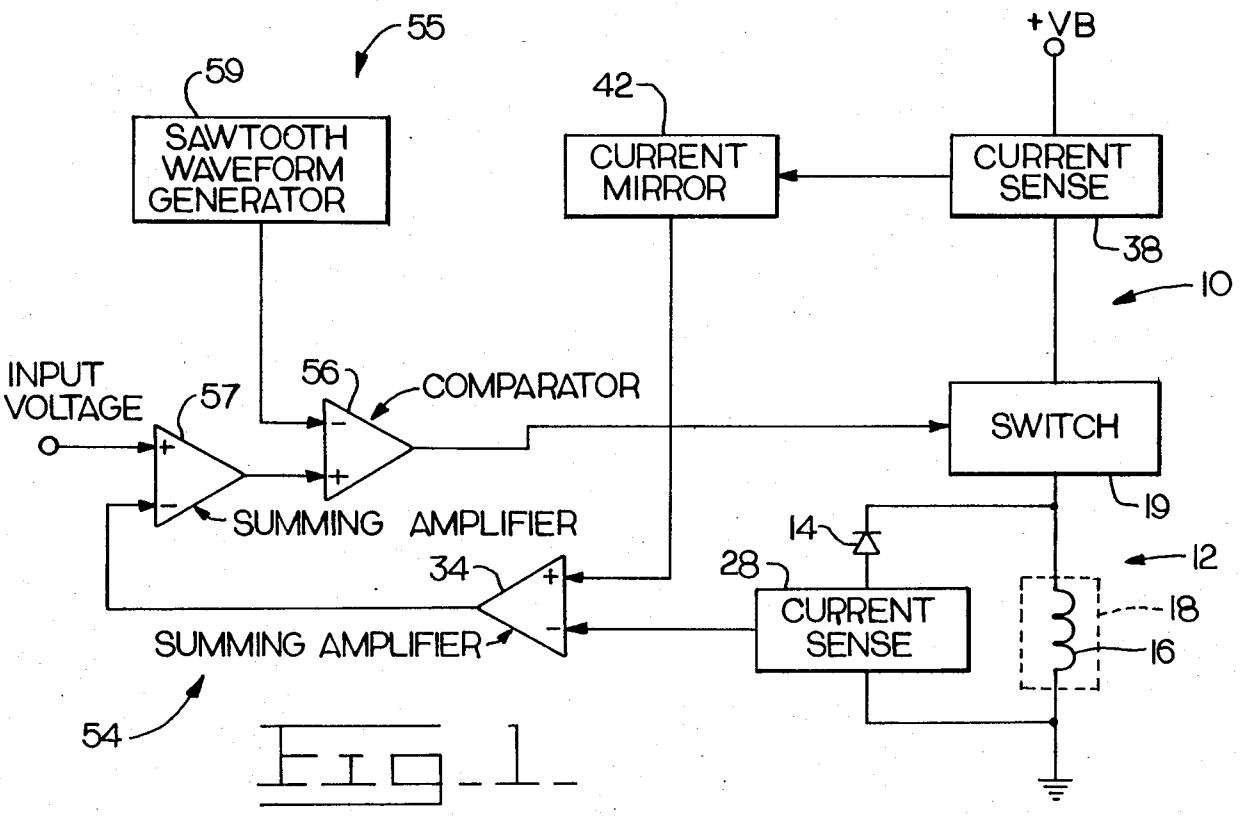
FIG. 1 illustrates a block diagram of an embodiment of the present invention.

Referring now to the drawings, wherein a preferred embodiment of the present driver circuit 10 is shown, FIG. 1 illustrates the driver circuit 10 which controllably connects an inductive load 12 to a source of electrical power $V_B$. The inductive load 12 includes a reverse biased flyback diode 14 connected in parallel with an inductive winding 16 of a solenoid 18. During energization of the winding 16, the flyback diode 14 is reverse biased by the positive reference of the source $V_B$ and no current flows through the diode 14; however, when the winding 16 is disconnected from the positive reference of the source $V_B$, the diode 14 provides a discharge current path to prevent the occurrence of damagingly large voltage spikes.

Figure 2:
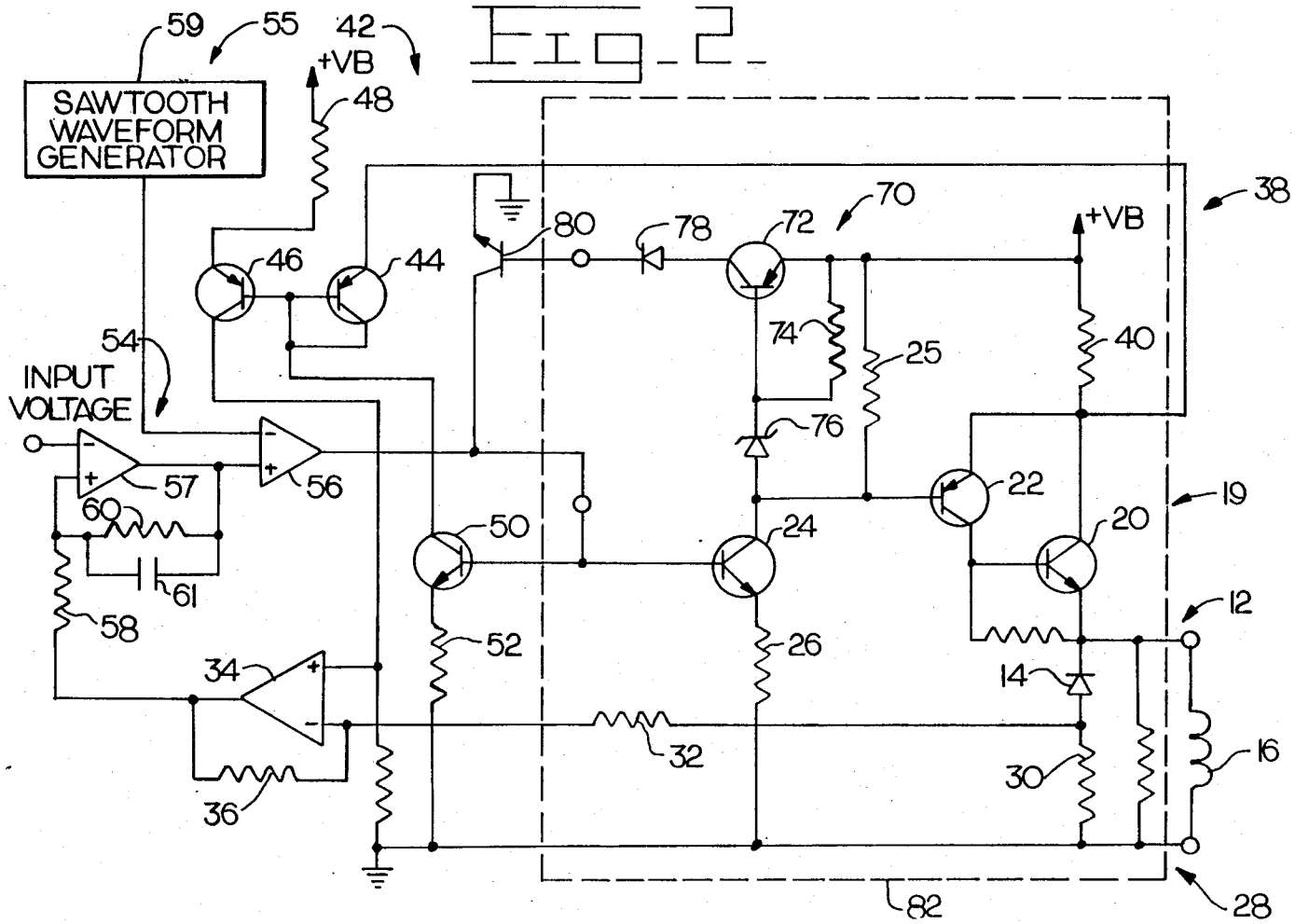
FIG. 2 illustrates a detailed electrical schematic of an embodiment of the present invention.

A first switching means 19 respectively connects and disconnects the inductive load 12 to and from the positive reference of the source $V_B$ in response to receiving a first and second control signal. The first switching means 19 includes (see FIG. 2) an npn type power transistor 20 connected in a Darlington pair arrangement with a pnp type transistor 22 where the collector and emitter of the power transistor 20 are respectively connected to the positive reference of the source $V_B$ and the winding 16. The base of the pnp transistor 22 is connected to the collector of a controlling transistor 24 and to the source $V_B$ through a resistor 25. The emitter of the controlling transitor 24 is connected to the negative reference of the source $V_B$ through a resistor 26. When a first positive logic signal is applied to the base of the transistor 24, current flows from the supply voltage through the resistor 25, transistor 24, and resistor 26 to the negative reference of the source $V_B$. The potential at the base of the pnp transistor 22 decreases and turns the transistor 22 "on". Current then flows from the positive reference of the source $V_B$ through the transistor 22 to the base of the power transistor 20 whereby the potential at the base of the power transistor 20 becomes positive and biases the power transistor 20 "on". Current then flows through transistor 22 energizing the winding 16.

A first means 28 senses the current flowing only through the flyback diode and delivers a signal which has a magnitude responsive to the magnitude of the flyback current. The first means 28 includes a current sensing resistor 30 connected between the anode of the flyback diode 14 and the negative reference of the source $V_B$. The junction of the resistor 30 and diode 14 is connected through a resistor 32 to a negative input of a summing amplifier 34. A feedback resistor 36 is connected between an output and the negative input of the summing amplifier 34. During current flyback when the power transistor 20 is biased "off", the energy stored in the winding 16 is dissipated through the resistor 30 and diode 14 in such a manner that the voltage drop across the resistor 30 is negative relative to the negative reference of the source $V_B$. Thus, the summing amplifier 34, by virtue of the connection to the negative input, inverts and amplifies the negative signal from the current sensing resistor 30 to deliver a positive signal which has a magnitude responsive to the magnitude of the actual flyback current. The location of the current sensing resistor 30 necessitates that only the flyback current will impact upon the voltage drop of the resistor 30. The resistor 30 is not positioned within the energization current path and will have zero voltage drop during energization of the winding 16.

A second means 38 senses the current flowing only through the switching means 19 and delivers a signal which has a magnitude proportional to the magnitude of the switching means current. The second means 38 includes a current sensing resistor 40 connected between the positive reference of the source $V_B$ and the collector of the power transistor 20. A current mirror circuit 42 is connected to the current sensing resistor 40 such that the current flowing through the resistor 40 is an input to the current mirror 42. The current mirror 42 includes first and second pnp type transistors 44,46, wherein both transistors 44,46 have bases one connected to the other and to the collector of the first transistor 44. The emitter of the first transistor 44 is connected to the source $V_B$ through the current sensing resistor 40 while the emitter of the second transistor 46 is also connected to the source $V_B$, but through a separate resistor 48. The collector of the second transistor 46 is connected to the non-inverting input of the summing amplifier 34.

The current mirror 42 delivers an output current signal which has a magnitude responsive to the magnitude of the current flowing through the current sensing resistor 40 to the summing amplifier. Selection of the ohmic value of the resistor 48 relative to the value of the current sensing resistor 40 determines the relationship between the input and output current of the mirror circuit 42. For example, in the preferred emobodiment the current sensing resistor 40 is selected to have a value of 0.301 ohms ± 1% and the resistor 48 is selected to have a resistive value of 301 ohms ± 1%. Thus, the output current of the mirror circuit 42 is directly proportional to the current delivered to the winding 16, but has a magnitude of only 1/1000th that of the energization current.

The interconnected bases of the transistors 44,46 are also connected to the negative reference of the source $V_B$ through a transistor 50 and resistor 52. The base of the transistor 50 is connected to the base of the transistor 24, such that when the previously discussed first "high" logic signal is applied to the base of the transistors 24,50, the transistor 50 is biased "on" connecting the bases of the transistors 44,46 to the negative reference of the source $V_B$ and enabling the current mirror 42 to deliver the output signal to the summing amplifier 34. Conversely, a second "low" logic signal delivered to the bases of the transistors 50,24 biases both of the transistors 50,24 "off" which in turn disables the current mirror 42 and biases the power transistor 20 "off".

A means 54 receives the flyback and switching current signals and delivers the first and second control signals to the switching means 19 at a preselected frequency and variable duty cycle. The duty cycle of the output signal is responsive to the magnitude of the summing amplifier output signal. The means 54 includes a comparator 56 which has a non-inverting input connected to the output of the summing amplifier 57 and an inverting input connected to a means 55 which delivers a voltage signal that repetitively varies linearly from a minimum to a maximum to a minimum and is commonly known as a sawtooth waveform generator 59. The amplifier 57 has a non-inverting terminal connected to the ouput of the amplifier 34 through a resistor 58 and to the ouput of the amplifier 57 through a resistor 60 and capacitor 61. The inverting input of the amplifier 57 is connected to a controllable input voltage which is supplied via an external controller (not shown) and has a voltage magnitude proportional to the current desired to flow through the winding 16. The voltage ouput of the summing amplifier 34 is proportional to the actual current flowing through the winding 16. The summing amplifier 57 performs a comparison between the actual and desired currents and outputs a voltage signal equivelant to the difference between the desired and actual current signals multiplied by a gain equal to the ratio of the feedback resistor 60 to the resistor 58, plus an offset voltage equal to the controllable input voltage. For example, if the actual and desired current signals were equal then the ouput signal would be equal to the controllable input voltage. A positive error causes the output to decrease below the controllable input voltage and, conversely, a negative error results in an output which is greater than the controllable input voltage. The output of the amplifier 57 is compared to the sawtooth waveform by the comparator 56 such that the comparator 56 outputs a pulse width modulated constant frequency signal. The magnitude of the amplifier 57 output determines the duty cycle output of the comparator 56. For example, if the output of the of the amplifier 57 is 75% of the maximum value of the sawtooth waveform, which is indicative of a large error, then the output of the comparator 56 is "high" for 75% of the cycle and "low" for 25% of the cycle. Conversely, if the output of the of the amplifier 57 is 25% of the maximum value of the sawtooth waveform, which is indicative of a small error, then the output of the comparator 56 is "low" for 75% of the cycle and "high" for 25% of the cycle.

From the description set forth herein, it becomes apparent that operation of the first and second current sensor means 16,38 are complemental in nature. Each can only deliver current during the period of time when the other is not operating. For example, the presence of flyback current indicates that the power transistor 20 must be biased "off" and no current is flowing through the second current sensing resistor 40. Further, while the output of the summing amplifier 34 is truly the sum of the two inputs, since neither input is simultaneously operational with the other, then the output is simply proportional to the individual inputs. The comparator 56 continually compares the magnitude of the output of the summing amplifier 57 to the sawtooth waveform and is biased "on" when the magnitude of the sawtooth waveform falls below the output of the amplifier 57. Similarly, the comparator 56 is biased "off" when the magnitude of the sawtooth waveform rises above the output of the summing amplifier 57.

A means 70 detects a short circuit condition of the winding 16 by monitoring the magnitude of the current delivered to the winding 16. The means 70 includes a pnp transistor 72 which has an emitter connected to the positive reference of the source $V_B$ and to the base of the transistor 72 through a resistor 74. A zener diode 76 is connected between the base of the transistor 72 and the collector of the transistor 24 with the polarity being so arranged as to connect the cathode of the diode 76 to the base of the transistor 72. In a short circuit condition, excessive current flows to the winding 16 effectively reducing the current flow through the resistors 25,74 causing the potential across diode 76 to decrease and turn transistor 72 "on". With transistor 72 biased "on", the positive reference of the source $V_B$ is connected through a protection diode 78 to the base of an npn type transistor 80. The transistor 80 has an emitter connected to the negative reference of the source $V_B$ and a collector connected to the bases of the transistors 24,50. During a short circuit condition, the transistor 80 is biased "on" which ultimately biases the power transistor 20 "off" independant of the magnitude of the current in either the first or second current sensing means 28,38.

To provide a low cost, reliable, and universal driver circuit, the electronic circuit enclosed within the dashed line 82 has been hybridized. The transistors and diodes remain discrete components; however, these components are assembled on a ceramic substrate and electrically interconnected by a metallization process. The resistors are formed by an inking process where the size and shape of the ink determines the ohmic value of the resistor. Owing to the resistors placement within the circuit, they are required to dissipate only small amounts of power and can, therefor, be formed using the very inexpensive inking process rather than a high wattage discrete component. This is true irrespective of any accidental shorts or connections to positive battery at the winding connections.

INDUSTRIAL APPLICABILITY

In the overall operation of the driver circuit 10, assume that the solenoid 19 is used to position a spool of an electronically controlled proportional hydraulic valve at a preselected position. The controllable input voltage provides a reference voltage to the comparator 57 indicative of a desired position of the valve spool. The driver circuit 10 will interact with the comparator 57 to maintain the current level in the winding 16 within prescribed limits of the desired current.

Initially, no current is flowing in the winding 16 and the signal from the summing amplifier 34 is appropriately zero. The amplifier 57 delivers a large error signal which ultimately biases the power transistor 20 "on" at a high duty cycle allowing current to begin flowing through the winding 16. The duty cycle of the signal applied to the power transistor 20 will continually be reduced as the current increases until such time as the current flowing through the first current sensing resistor 40 rises to the prescribed reference.

During the "low" portions of the duty cycle signal, flyback current flows through the second current sensing resistor 30 and decays at an exponential rate. As the current decays the actual current signal decreases causing the error signal output by the amplifier 57 to increase and appropriately adjust the duty cycle.

Other aspects, objects, and advantages of this invention can be obtained from a study of the drawings, the disclosure, and the appended claims.

We claim:

1. A driver circuit (10) for controllably connecting an inductive load (12) to a source of electical power, said inductive load (12) having a reverse biased flyback diode (14) connected in parallel with an inductive winding (16) of a solenoid (18) comprising:

switching means (19) for respectively connecting and disconnecting, at a constant preselected frequency, said inductive load (12) to and from said source in response to receiving a first and second control signal;

first means (28) for sensing the current flowing through only said flyback diode (14) and delivering a signal having a magnitude responsive to the magnitude of said flyback current;

second means (38) connected between the power source and the switching means (19), for sensing the current flowing through only said switching means (19) and delivering a signal having a magnitude proportional to the magnitude of the switching means current; and means (54) for receiving said flyback and switching current signals and delivering said first and second control signals to said switching means (19) at a preselected frequency and variable duty cycle, said duty cycle being responsive to the magnitude of said flyback and switching current signals.

2. The driver circuit, as set forth in claim 1, wherein said first means includes a resistor connected between a ground reference of the source of electrical power and the anode of said flyback diode.

3. The driver circuit, as set forth in claim 2, wherein said first means includes a summing amplifier having an input connected to the junction of said resistor and flyback diode.

4. The driver circuit, as set forth in claim 1, wherein said second means includes a resistor connected between a positive reference of the source of electrical power and said switching means.

5. The driver circuit, as set forth in claim 4, wherein said second means includes a current mirror circuit having the current flowing through said first current sensing resistor as an input to said current mirror.

6. The driver circuit, as set forth in claim 5, wherein said current mirror delivers an output current signal having a magnitude responsive to the magnitude of said current flowing through said first current sensing resistor to one input of a summing amplifier.

7. An apparatus for adaptively controlling the energization of the windings of a solenoid, comprising:

a source of electrical power;

a first current sensing resistor;

a second current sensing resistor;

a power transistor having a base, an emitter connected to the negative reference of said source of electrical power through the windings of said solenoid, and a collector connected to the positive reference of said source of electrical power through said first current sensing resistor;

a flyback diode having a cathode connected to the emitter of said power transistor and an anode connected to the negative reference of said source of electrical power through said second current sensing resistor;

a summing amplifier having a non-inverting input, an inverting input connected to the anode of said flyback diode, and an output adapted for delivering a signal having a magnitude proportional to the magnitude of the sum of said inverting and non-inverting inputs;

a current mirror circuit having an input connected to the collector of said power transistor and an output connected to the non-inverting input of said summing amplifier;

comparator means for receiving said summing amplifier output signal and delivering said first and second control signals to the base of said power transistor at a preselected frequency and variable duty cycle, said duty cycle being responsive to the magnitude of said summing amplifier output signal, said first signal being of a magnitude sufficient for biasing said power transistor on, and said second control signal being of a magnitude sufficient for biasing said power transistor off.

* * * * *